US011318352B2

(12) United States Patent
DeCesare

(10) Patent No.: US 11,318,352 B2
(45) Date of Patent: May 3, 2022

(54) EXERCISE DEVICE TO PROMOTE, MEASURE AND ANALYZE LEG MOVEMENTS WHILE SEATED

(71) Applicant: Michael DeCesare, East Brunswick, NJ (US)

(72) Inventor: Michael DeCesare, East Brunswick, NJ (US)

( * ) Notice: Subject to any disclaimer, the term of this patent is extended or adjusted under 35 U.S.C. 154(b) by 225 days.

(21) Appl. No.: 16/889,424

(22) Filed: Jun. 1, 2020

(65) Prior Publication Data

US 2020/0289892 A1 Sep. 17, 2020

Related U.S. Application Data

(63) Continuation-in-part of application No. 15/494,345, filed on Apr. 21, 2017, now abandoned.

(60) Provisional application No. 62/328,980, filed on Apr. 28, 2016.

(51) Int. Cl.

| | |
|---|---|
| ***A63B 24/00*** | (2006.01) |
| ***A63B 22/20*** | (2006.01) |
| ***A63B 21/012*** | (2006.01) |
| ***A63B 21/06*** | (2006.01) |
| ***A63B 71/06*** | (2006.01) |

(52) U.S. Cl.

CPC ..... *A63B 24/0062* (2013.01); *A63B 21/012* (2013.01); *A63B 21/06* (2013.01); *A63B 22/20* (2013.01); *A63B 2071/0694* (2013.01); *A63B 2208/0233* (2013.01); *A63B 2209/00* (2013.01); *A63B 2220/803* (2013.01); *A63B 2220/833* (2013.01)

(58) Field of Classification Search

CPC ..... A63B 22/20–208; A63B 24/0062; A63B 2071/0694; A63B 2208/0233; A63B 2209/00; A63B 2220/803; A63B 2220/833; A63B 21/012; A63B 21/06

See application file for complete search history.

(56) References Cited

U.S. PATENT DOCUMENTS

| | | | | |
|---|---|---|---|---|
| 3,517,928 A * | 6/1970 | Shanahan | ..... | A43B 3/0031 482/79 |
| 5,127,892 A * | 7/1992 | Sawdon | ..... | A63B 23/10 482/79 |
| 2010/0317496 A1* | 12/2010 | Abranchess | ..... | A63B 23/12 482/141 |

(Continued)

*Primary Examiner* — Jennifer Robertson

(74) *Attorney, Agent, or Firm* — Christopher Pilling

(57) ABSTRACT

A seated exercise system is provided having a pair of sliders devices, each slider device including a body portion having a continuous side wall and a support surface. The support surface is sized and shaped to receive a foot of a user. A floor portion configured to slide on a floor surface during operation is provided. A grip portion is attached to the support surface, wherein the grip portion is constructed from a traction material providing traction to the foot during operation. Motion tracking components configured to detect movement data of the foot and during operation are provided. At least one slider of the pair of floor sliders is configured to communicate the detected movement data to the other slider; and, wherein at least one slider of the pair of floor sliders includes a wireless communication device configured to send the detected movement data a computerized device such that the detected movement data is available to the user.

14 Claims, 12 Drawing Sheets

(56) References Cited

U.S. PATENT DOCUMENTS

| | | | | |
|---|---|---|---|---|
| 2012/0289378 | A1* | 11/2012 | Sperry | A63B 22/18 482/8 |
| 2013/0252791 | A1* | 9/2013 | Chang | A63B 23/03541 482/132 |
| 2014/0100090 | A1* | 4/2014 | Lima | A63B 23/1236 482/139 |
| 2016/0114209 | A1* | 4/2016 | Trenkle | A63B 21/0004 482/79 |
| 2016/0175635 | A1* | 6/2016 | Westenberg | A63B 21/4019 482/114 |
| 2017/0043219 | A1* | 2/2017 | Polinsky | A63F 13/245 |
| 2017/0050082 | A1* | 2/2017 | Whitaker | A63B 21/0004 |
| 2018/0318639 | A1* | 11/2018 | Kim | A63B 22/205 |

* cited by examiner

EXERCISE DEVICE TO PROMOTE, MEASURE AND ANALYZE LEG MOVEMENTS WHILE SEATED

CROSS-REFERENCE TO RELATED APPLICATIONS

The present application is a continuation in part application to U.S. Nonprovisional application Ser. No. 15/494,345, filed on Apr. 21, 2017 entitled "Seated Exercise Device", which claims priority to U.S. Provisional Application Ser. No. 62/328,980, filed on Apr. 28, 2016 entitled "Seated Exercise Device", the disclosures of which are hereby incorporated in their entirety at least by reference.

BACKGROUND OF THE INVENTION

1. Field of the Invention

The present invention generally relates to exercise devices, and more particularly to a seated exercise device.

2. Description of Related Art

The present invention generally relates to exercise devices, and more particularly to a seated exercise device. It is generally known that the human body is designed for regular movement, but it is common for a typical person to spend 9 to 10 hours a day sitting. Long hours of sitting can be linked to several heath concerns, including but not limited to heart disease, diabetes, cancers, obesity, and leg conditions. Consequently, there is a need to for a seated exercise device allowing users to stay active, and improve their health while in a seated position.

BRIEF SUMMARY OF THE INVENTION

The following presents a simplified summary of some embodiments of the invention in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented later.

It is a main object of the present disclosure to provide a device that enables a user to exercise while seated, and view and record fitness information related to use of the device.

In order to do so, a seated exercise system is provided, comprising: a pair of sliders devices, each slider device comprising: a body portion having a continuous side wall and a support surface, wherein the support surface is sized and shaped to receive a foot of a user; a floor portion configured to slide on a floor surface during operation; a grip portion attached to the support surface, wherein the grip portion is constructed from a traction material providing traction to the foot during operation; and, motion tracking components configured to detect movement data of the foot and during operation; wherein at least one slider of the pair of floor sliders is configured to communicate the detected movement data to the other slider; and, wherein at least one slider of the pair of floor sliders includes a wireless communication device configured to send the detected movement data a computerized device such that the detected movement data is available to the user.

The foregoing has outlined rather broadly the more pertinent and important features of the present disclosure so that the detailed description of the invention that follows may be better understood and so that the present contribution to the art can be more fully appreciated. Additional features of the invention will be described hereinafter which form the subject of the claims of the invention. It should be appreciated by those skilled in the art that the conception and the disclosed specific methods and structures may be readily utilized as a basis for modifying or designing other structures for carrying out the same purposes of the present disclosure. It should be realized by those skilled in the art that such equivalent structures do not depart from the spirit and scope of the invention as set forth in the appended claims.

BRIEF DESCRIPTION OF THE SEVERAL VIEWS OF THE DRAWINGS

Other features and advantages of the present invention will become apparent when the following detailed description is read in conjunction with the accompanying drawings, in which.

DETAILED DESCRIPTION OF THE PREFERRED EMBODIMENT

The following description is provided to enable person skilled in the art to snake use the invention and sets forth the best modes contemplated by the inventor of carrying out their invention. Various modifications, however, will remain readily apparent to those skilled in the art, since the general principles of the present invention have been defined herein to specifically provide a seated exercise device.

Figure 1A:
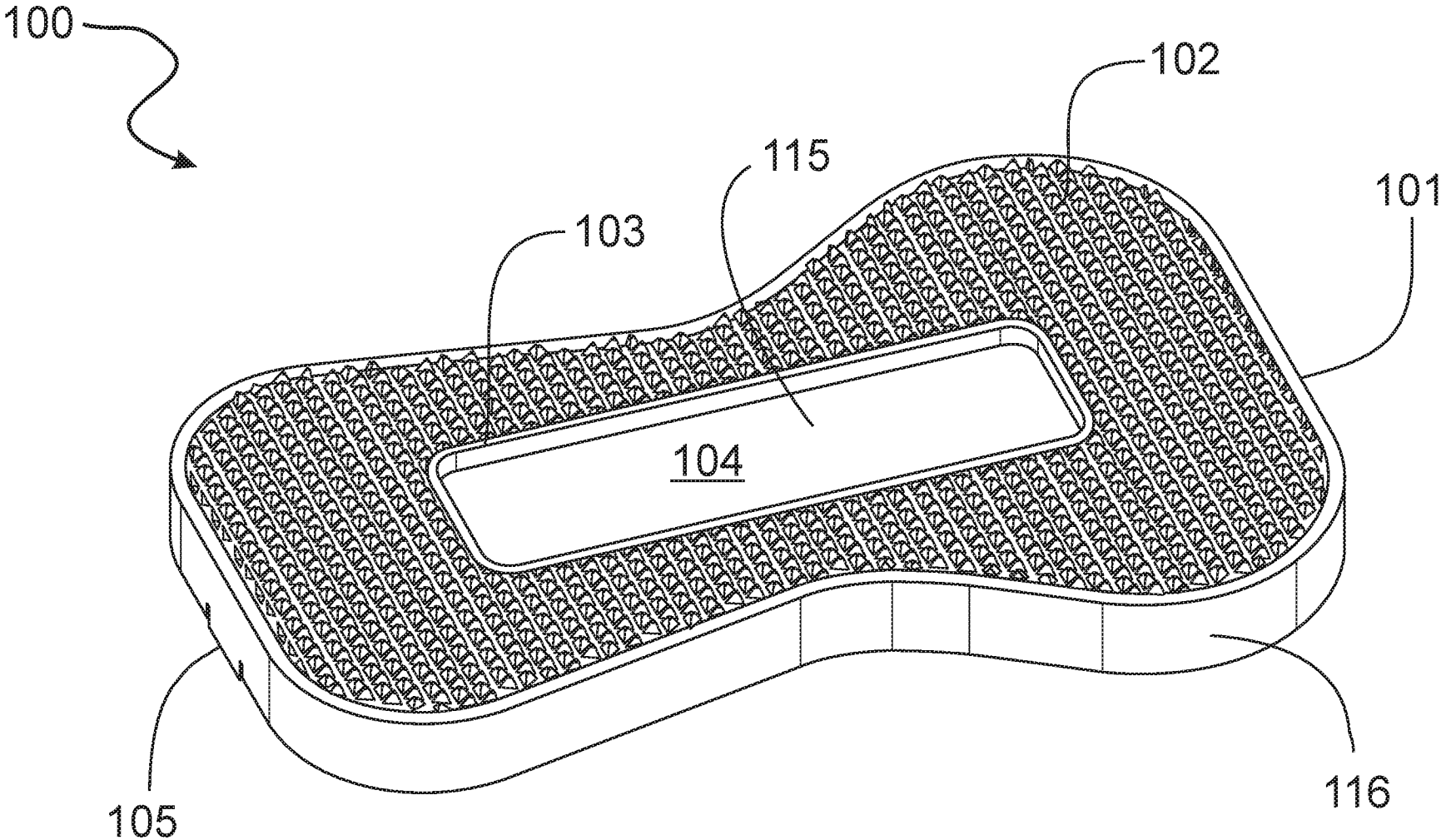
FIG. 1A is a top perspective view of a seated exercise device according to an embodiment of the present invention.
Figure 1B:
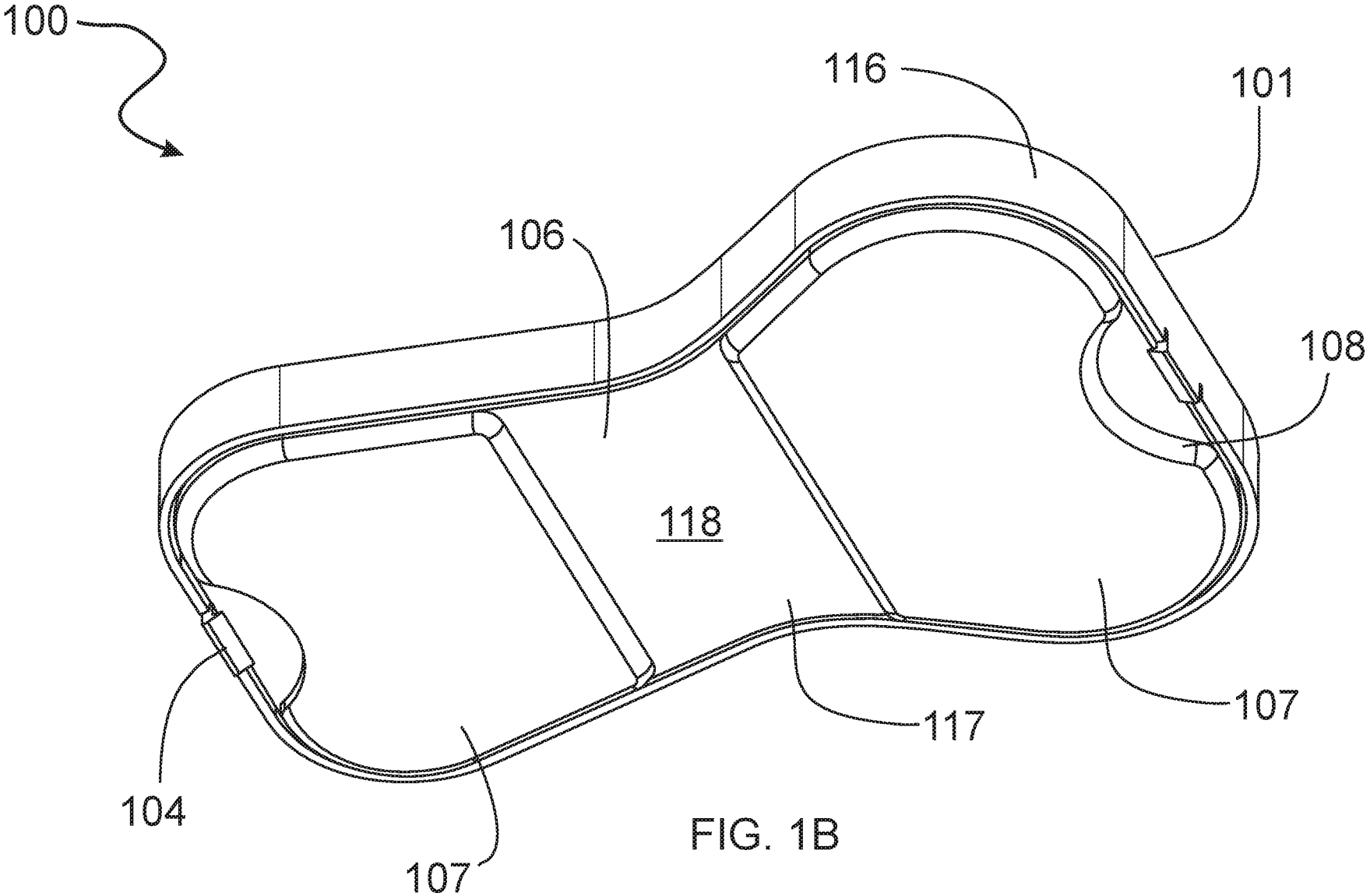
FIG. 1B is a rear perspective view of a seated exercise device according to an embodiment of the present invention.
Figure 1C:
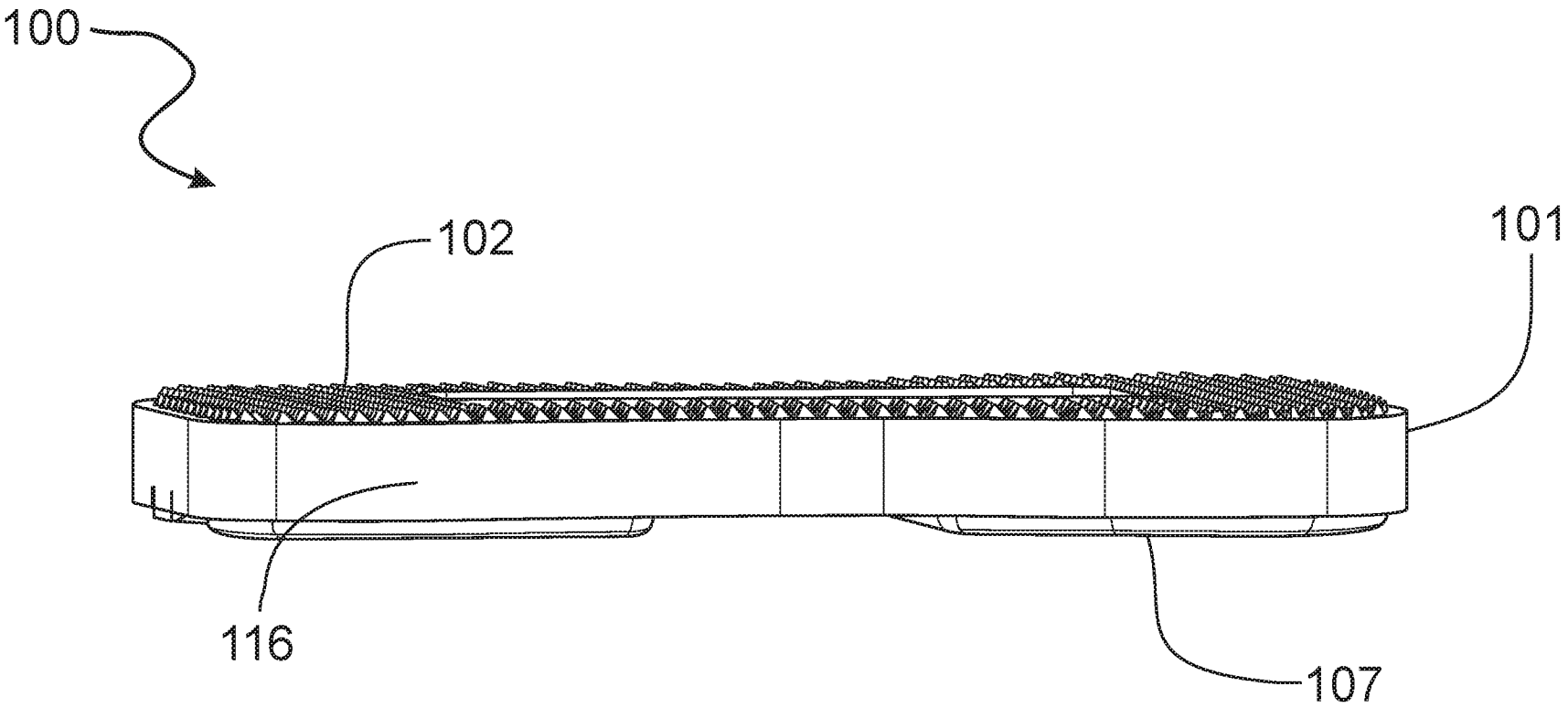
FIG. 1C is a side perspective view of a seated exercise device according to an embodiment of the present invention.

FIGS. 1A-C are perspective views of a seated exercise device 100 according to an embodiment of the present invention. The seated exercise device comprises a body portion 101, a grip portion 102, and a reversible floor portion 106. The body portion is comprised of an hourglass shape having a support surface 115 and a continuous side wall 116, wherein the body portion is configured to hold both the grip portion and the reversible floor portion. It should be understood that the shape of the body portion may be modified, without departing from the spirit of the invention. In one embodiment, the support surface is sized and shaped to receive a foot of a user. In one embodiment, the body portion is constructed from a plastic material, such as polypropylene. In alternative embodiments, the body portion is made of a metal.

In one embodiment, the grip portion is constructed from a rubber material, providing traction for a user during use.

Although rubber is preferred, it is understood that a similar material may be used to provide grip and traction, including but not limited to thermoplastic elastomers (TPE), styrene ethylene butylene styrene (SEBS), or thermoplastic polyurethane (TPU). The grip portion is sized and shaped to be received in the body portion. A retaining lip 112 (FIG. 2) located on the perimeter of the support surface helps retain the grip portion. In one embodiment, the grip portion may be attached to the support surface of the body portion using any adhesion method known in the art. The grip portion includes a rectangular cutout 103 in a center section of the grip portion. The rectangular cutout allows an insignia, logo, symbol or other identifying mark 104 included on the support surface of the body portion to be visible. A specific identifying mark is not illustrated, but it is understood that the identifying mark, such as a product name or a company name may be present. In one embodiment, the grip portion does not include the rectangular cutout, and the grip portion is covers the entirety of the support surface.

The reversible floor portion includes a base member 117 having a first 118 and second side 119 (FIG. 2) respectively. In one embodiment, the base member is constructed from a plastic material, such as polypropylene. In alternative embodiments, the base member is made of a metal. The base member may be reversed by the user to access features and elements on the second side. The first side of the base member includes a first pair of floor sliders 107; each of the first pair of floor sliders is sized to fit their respective locations (as illustrated) on the reversible floor portion. The reversible floor portion is configured to be attached to the body portion via attachment clips 105 positioned the continuous side wall of the body portion. Each of the pair of floor sliders includes a first circular cutout allowing the user to access the attachment clips. Although, a specific attachment means is disclosed, it is understood that any, type of attachment means may be provided including but not limited to a threaded connection, hardware, or any attachment means known in the art.

Figure 2:
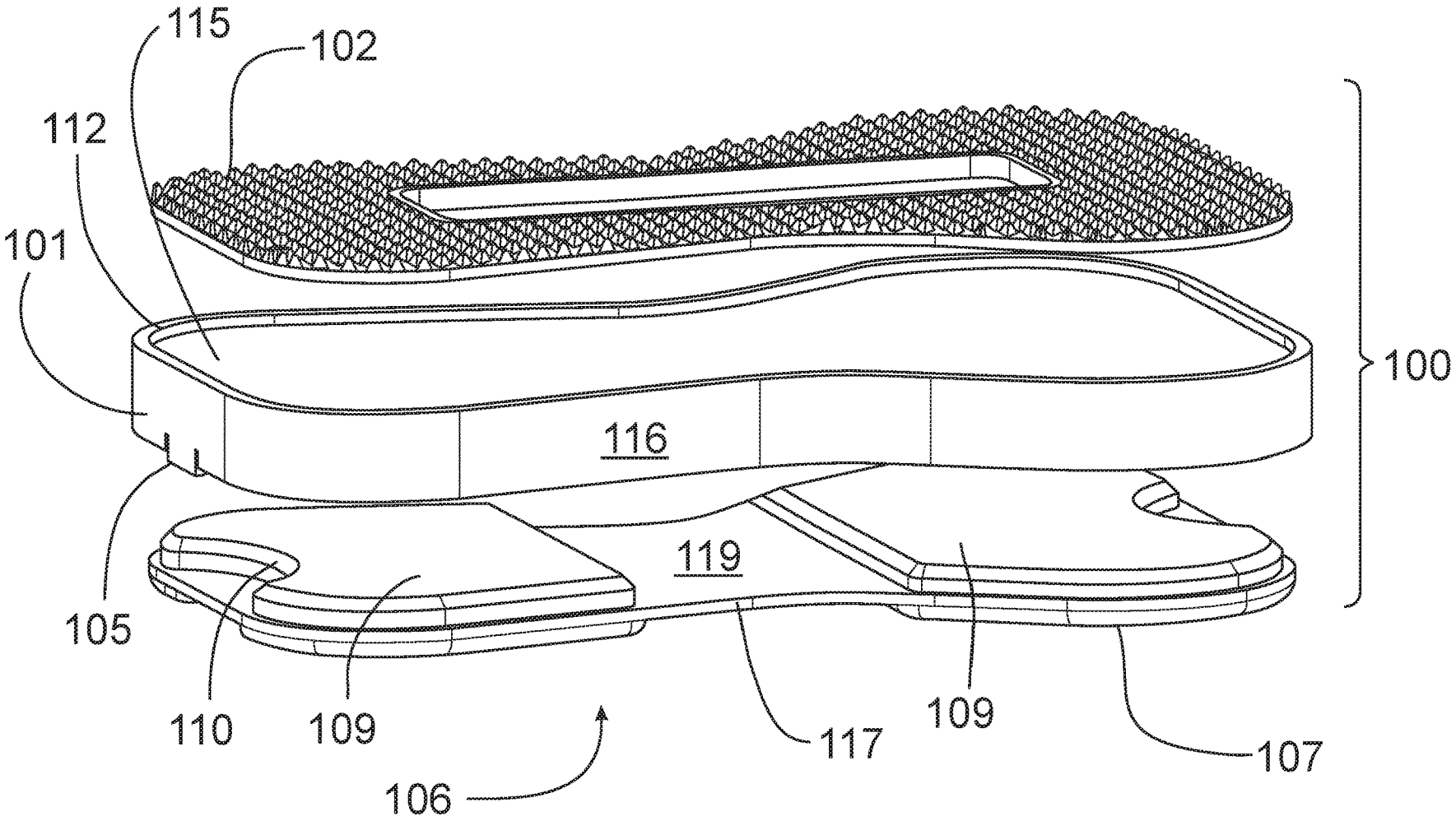
FIG. 2 is an exploded view of a seated exercise device according to an embodiment of the present invention.

FIG. 2 is an exploded view of the seated exercise device of FIG. 1. Now referring to FIG. 2, the reversible slider and the second side is illustrated. The second size of the base member includes a second pair of floor sliders 109; each of the second pair of floor sliders is sized to fit their respective locations (as illustrated) on the reversible floor portion. Similarly to the first pair of floor sliders, each of the second pair of floor sliders includes a second circular cutout 110 allowing the user to access the attachment clips. On the first side, each of the first pair of floor sliders is constructed from a low friction polymer. The first side and corresponding first pair of floor sliders are ideal for use on carpeted surfaces. In one embodiment, the low friction polymer is Polytetrafluoroethylene (PTFE) or Teflon. On the second side, each of the second pair of floor sliders is constructed from a fabric material. The second side and corresponding second pair of floor sliders are ideal for use on hard surface, such as hard wood flooring and tile. In one embodiment, the fabric material is wool, felt, cloth, or a similar fabric material. The operation and use of the seated exercise device will be discussed in greater detail below.

It should be understood, that in alternative embodiments, the first and/or second side can include only one floor slider. In the various embodiments described, the size of the floor sliders may vary, including the amount of space occupied on the base number. For example, in one embodiment, a single floor slider or a pair of floor sliders may occupy a majority of the base member, such as 90%. In other embodiments, a single floor slider or a pair of floor sliders may occupy approximately half of the base member, or close to 50%. Generally, since the floor slider or pair of floor sliders are the components of the seated exercise device that make physical contact with a floor surface, it is preferred that the single floor slider or a pair of floor sliders occupy at least 50% of the base member. Ideally, the amount of space that the single floor slider or a pair of floor sliders occupy on the base number should be consistent between the first and second side of the base member, however it is understood that the occupying percentage may vary from the first side to the second side.

Figure 3:
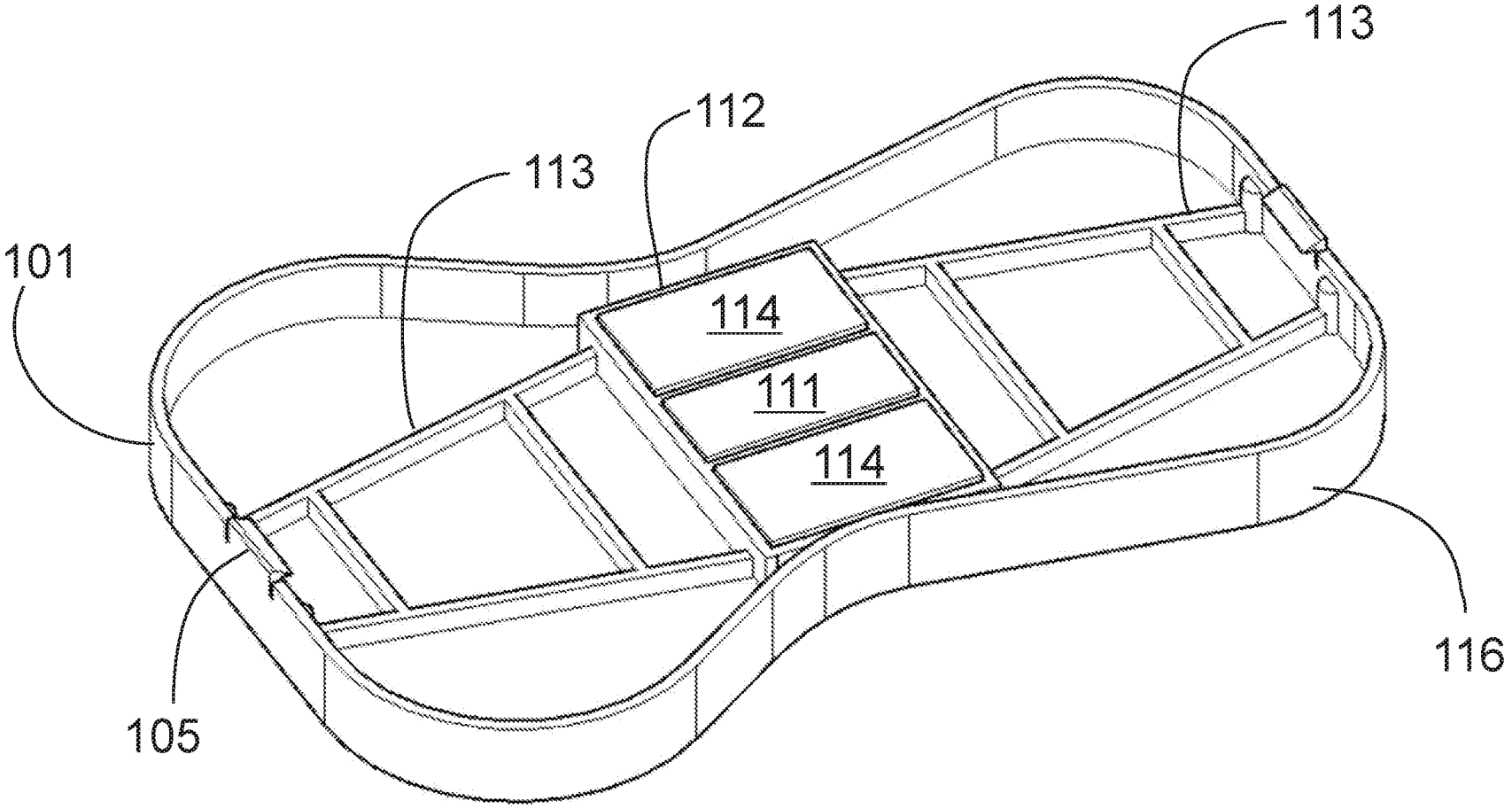
FIG. 3 is rear perspective view of a body portion of a seated exercise device including installed optional components according to an embodiment of the present invention.

FIG. 3 is rear perspective view of the body portion of the seated exercise device. Referring now to FIG. 3, the body portion includes a plurality of cavities 112 and structural support 113. The plurality of cavities includes interior cavities providing containment for an optional activity tracker 111 and optional weights 114. The motion tracking system or activity tracker is optional, and is intended to be removed from the housing for accessing fitness data and for charging purposes. The activity tracker provides the user with fitness data generated from use. In alterative embodiments, a charging and data transfer means may be provide on the continuous side wall body portion preventing the user from having to remove the activity tracker for data and charging purposes. The activity tracker includes a number of electrical components including but not limited to a printed circuit board, LEDs, accelerometer, gyroscope, rechargeable battery, coin buzzer, and other components. In one embodiment, a micro USB port is provided allowing the user to access any recorded data or charge the rechargeable battery. In alternative embodiments, the fitness tracker includes wireless connectivity allowing users to connect with the fitness tracker to access the data without physically removing the tracker. In some embodiment, the fitness tracker is linked with a web application, or mobile application providing a user interface to access the fitness data. The fitness data may include the movement of the device over a specific time interval, the speed of the movement, type of the movement (rotational or linear), and calorie burn based on user metrics. Variations of the motion tracking system will be discussed in greater detail below.

In one embodiment, the optional weights may be added if a user desires to add more resistance during operation. The weights may be positioned in the interior cavities requiring more effort to move the seated exercise device during use. This configuration is a form of strength training as well known in the art. Although two optional weights are illustrated, it is understood that the amount of weights may vary, as well as the number of cavities in the plurality of cavities. The seated exercise device is intended to be used in pairs, i.e. one device per foot. It is recommended to operate the device while seated, such as at a desk during working hours. It is a particular advantage of the seated exercise device to be used discreetly, without hindering the ability to do common work tasks, such as speaking on the phone, writing emails, etc. This is an advantage over bulky exercises devices such as treadmill desks and desk cycles.

In operation, a user simply places each foot on a single seated exercise device, then moves the devices in random directions, including linear motions, circular, figure eight, or small rotations and wiggles. It is intended for the user to do what feels natural allowing their legs to be in constant motion, improving blood circulation and minimizing the detrimental effects of being seating for long time periods. The seated exercises devices may be used with any type of shoe, sock, or be operated barefoot. In some embodiments, the device may be used without the activity tracker. In alternative embodiment, the activity tracker may only be provided in one of the two devices.

Figure 4:
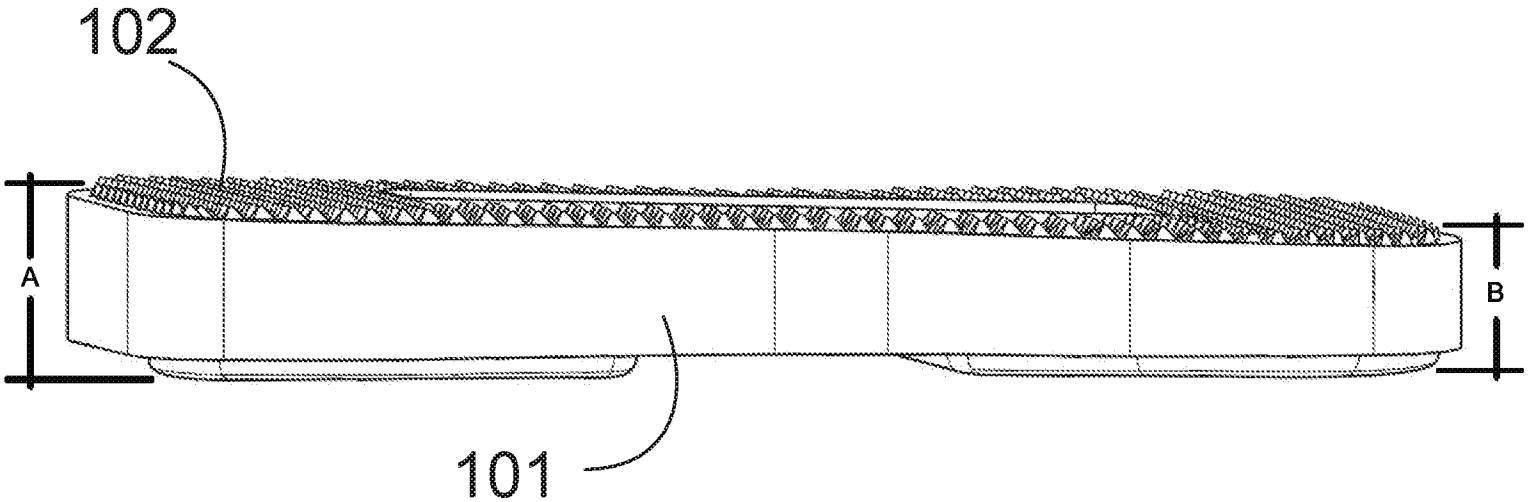
FIG. 4 is a side perspective view of an alternative seated exercise device according to an embodiment of the present invention.

FIG. 4 is a side perspective view of an alternative seated exercise device according to an embodiment of the present invention. Referring now to FIG. 4, the alternative seated exercise device comprises a body portion 101 having angled support surface (not shown) such that the grip portion 102 is at an angle, wherein one side of the device is higher than the opposite side (shown as "A" and "B"). Each slider of the pair of sliders may include an angled surface, one slider of the pair of sliders, or the sliders may be relatively flat as previously discussed. Advantageously, the angled surface allows different foot, leg, and calf muscles to be stimulated during use. Further, the user may position their food at different positions on the angled surface to isolate specific muscles. For example, the user may position their foot such that the toes are up (higher) and the heel is down (lower) or the user may position their foot such that the toes are down (lower) and the heel is up (higher). In other embodiments, the support surface may include both an angled surface a flat surface giving the user the option of foot positioning and muscle stimulation.

FIGS. 5A-F are diagrams illustrating various embodiments of the motion tracking system. As previously discussed, during use, while seated, a user will place one foot on each slider device slider "A" and slider "B" as seen in FIGS. 5A-F, and slide them on the floor independently of each other with the purpose of promoting movement of the lower extremities, stimulating muscles, reducing fatigue, and preventing the dangers of being in a prolonged sitting position. Advantageously, a notion tracking system is included in the slider devices (in the body portion such as the plurality of cavities 112 and/or structural support 113; see FIG. 3) to collect movement data from usage of the sliders. Movement data from each device, slider "A" and slider "B" are sensed, tracked, and assessed. In some embodiments, the movements that are detected may be linear, circular, or fidget type movements, including but not limited to, tapping, bouncing, twisting of one or both feet simultaneously. The collected movement data, such as acceleration, rotation, and length of time, will then be converted into units of estimated energy spent during usage of the device and then into statistics such as equivalent steps taken, calories burned, etc. Multiple configurations of the motion tracking system may be provided and some examples will be discussed below. It should be understood, that various components and configurations are discussed below in relation to slider "A" and slider "B", however the components may be switched to the other slider or replaced with a similar components. Further, this is not intended to be an exhaustive list and components and configuration may vary.

Figure 5A:
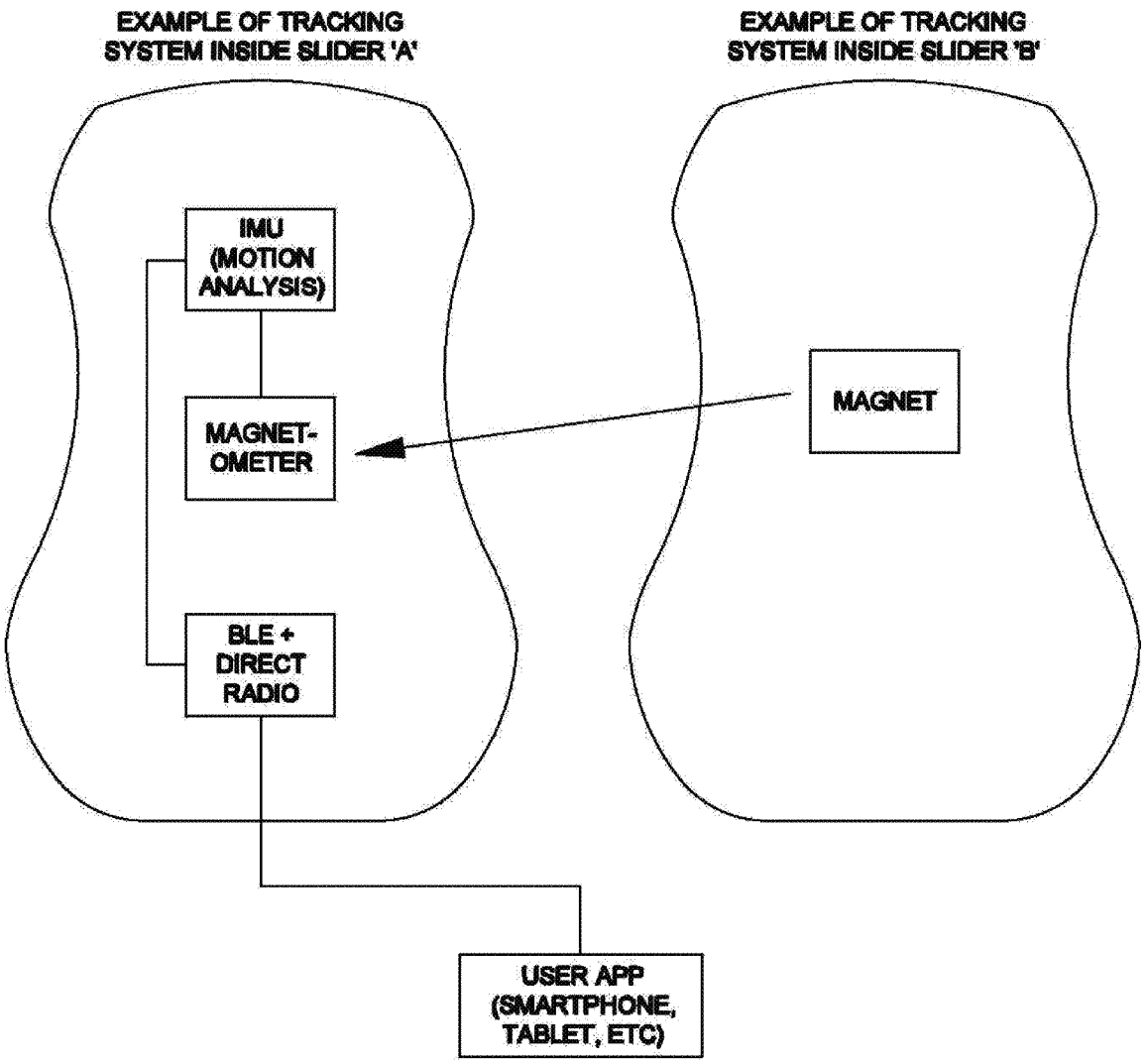
FIGS. 5A-F are diagrams illustrating various embodiments of the motion tracking system.
Figure 5B:
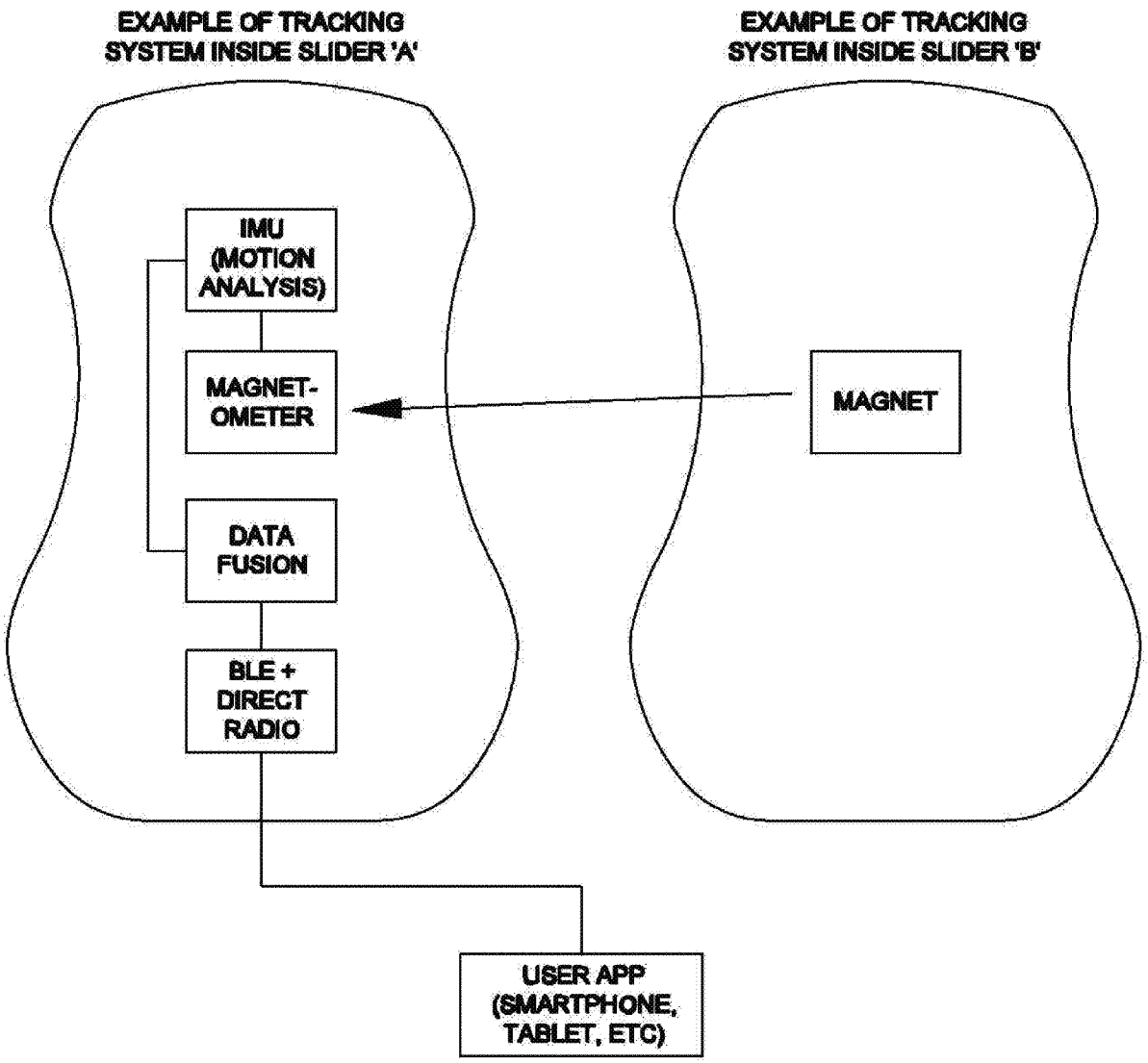

In FIG. 5A, slider "A" includes an IMU (inertial measurement unit) for motion sensing and both direct radio and BLE (Bluetooth low energy) capability. In other embodiments, other communication technologies may be used. In one embodiment, the IMU will include a minimum) 3-axis accelerometer, a (minimum) 3-axis gyroscope, and a magnetometer (to measure movement of slider "B"). In this embodiment, slider "B" has a magnet fixed in place inside the device. During use, data is transferred at set intervals via the BLE from slider "A" to external processing, such as a user application executed on a smartphone or tablet, wherein the user application is configured to be used with the present invention for data tracking. The smartphone has all the components necessary to receive the data transfer as well known in the art, such that the user may view their movement data. The activity is calculated by analysis of IMU data of slider "A" combined with slider "B". In FIG. 5B, an on-board data fusion is added to slider "A", wherein the on-board data fusion enables all relevant processing to be performed and completed on the slider "A" such that the system doesn't depend on an external application for data processing as the configuration in FIG. 5A.

Figure 5C:
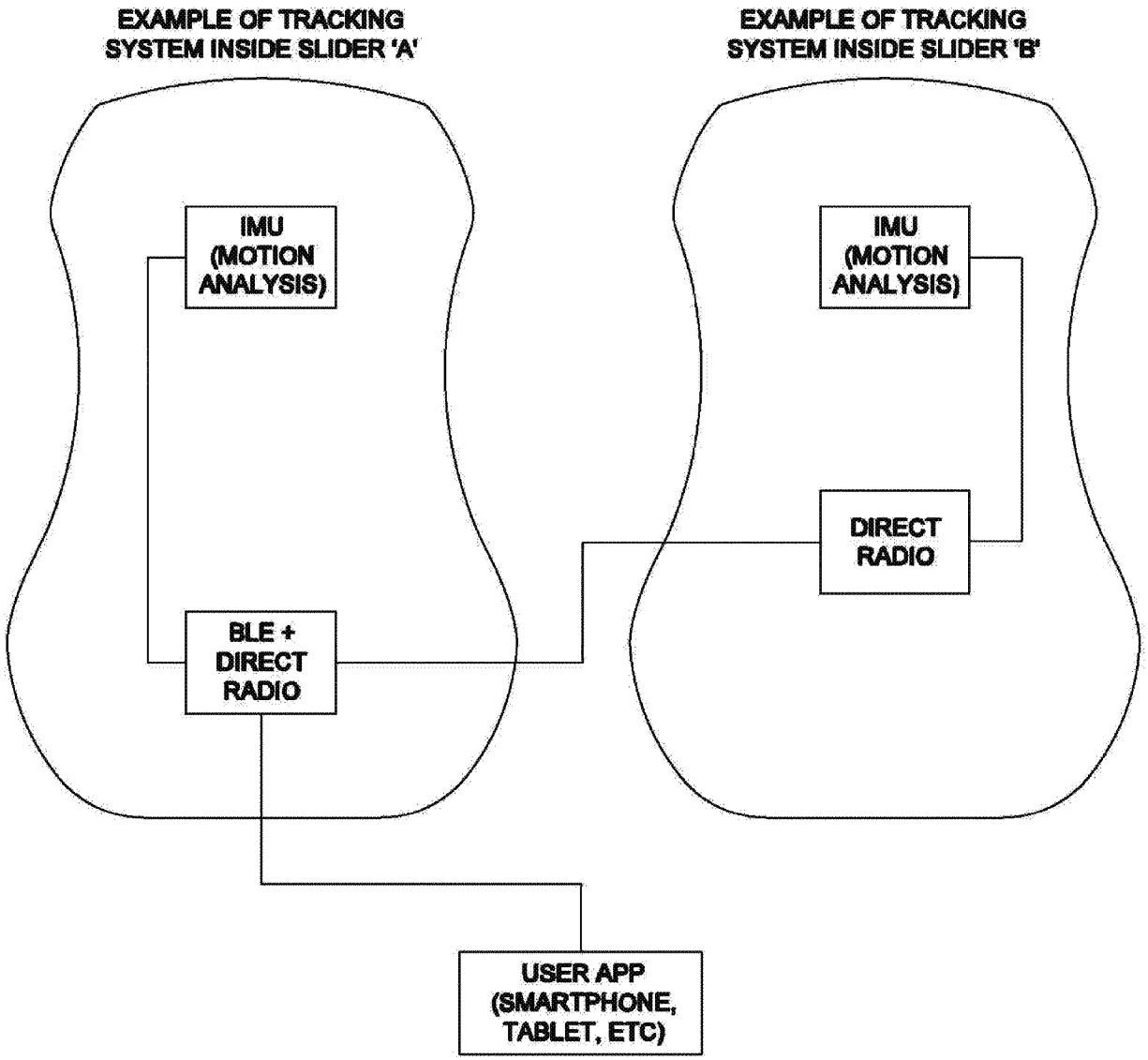
Figure 5D:
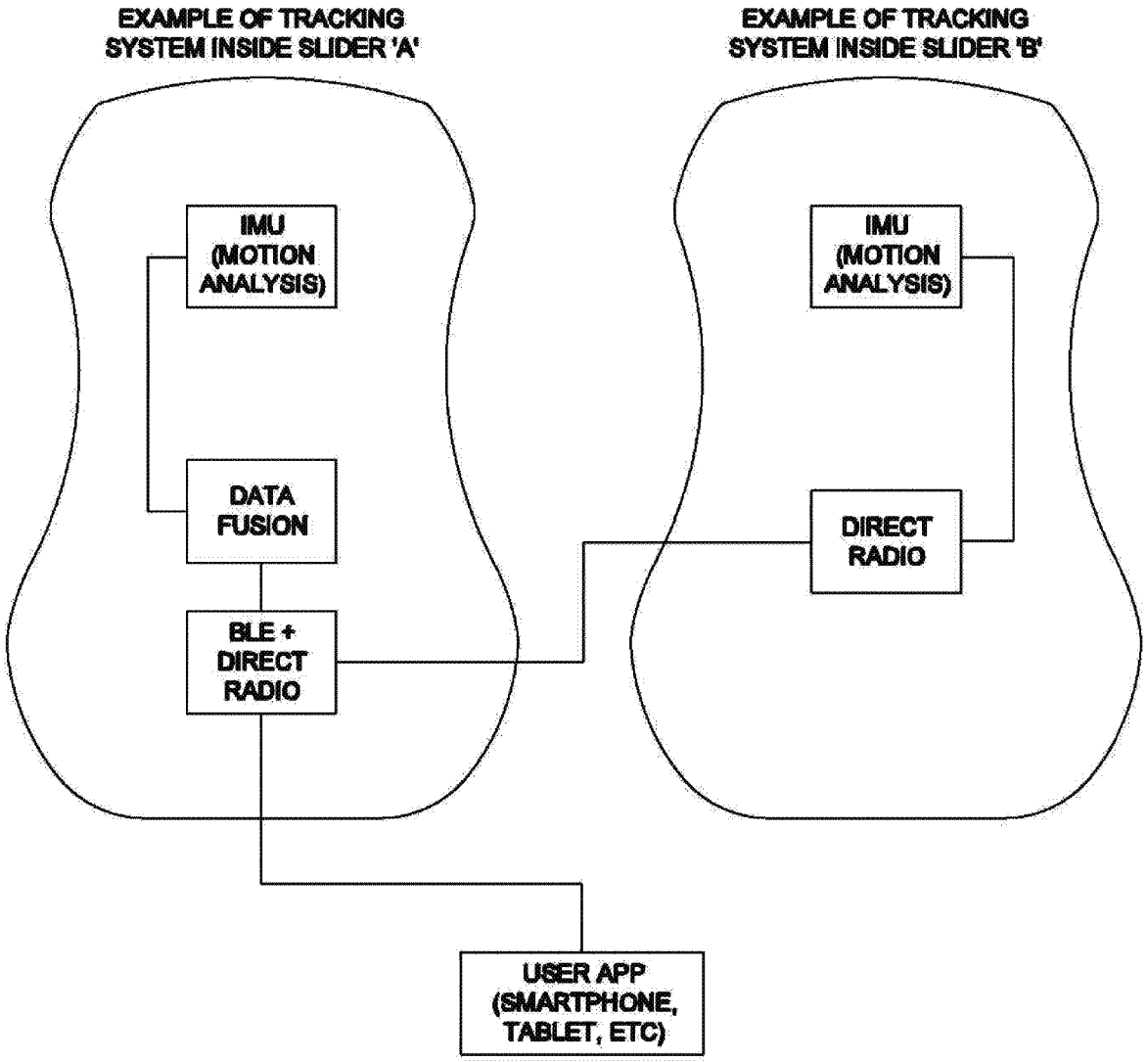

In FIG. 5C, slider "A" includes an IMU for motion sensing and both direct radio and BLE capability, or another communication device, wherein slider "B" includes an IMU for motion sensing and uses direct radio to transmit its data to slider "A". The IMU's will each include a (minimum) 3-axis accelerometer and a (minimum) 3-axis gyroscope. Data is transferred at set intervals from slider "A" via BLE to external processing (smartphone, tablet, etc. as previously discussed). Activity is calculated by analysis of IMU data of slider "A" combined with slider "B". In FIG. 5D, an on-board data fusion is added to slider "A", wherein the on-board data fusion enables all relevant processing to be performed and completed on the slider "A" such that the system doesn't depend on an external application for data processing as the configuration in FIG. 5C.

Figure 5E:
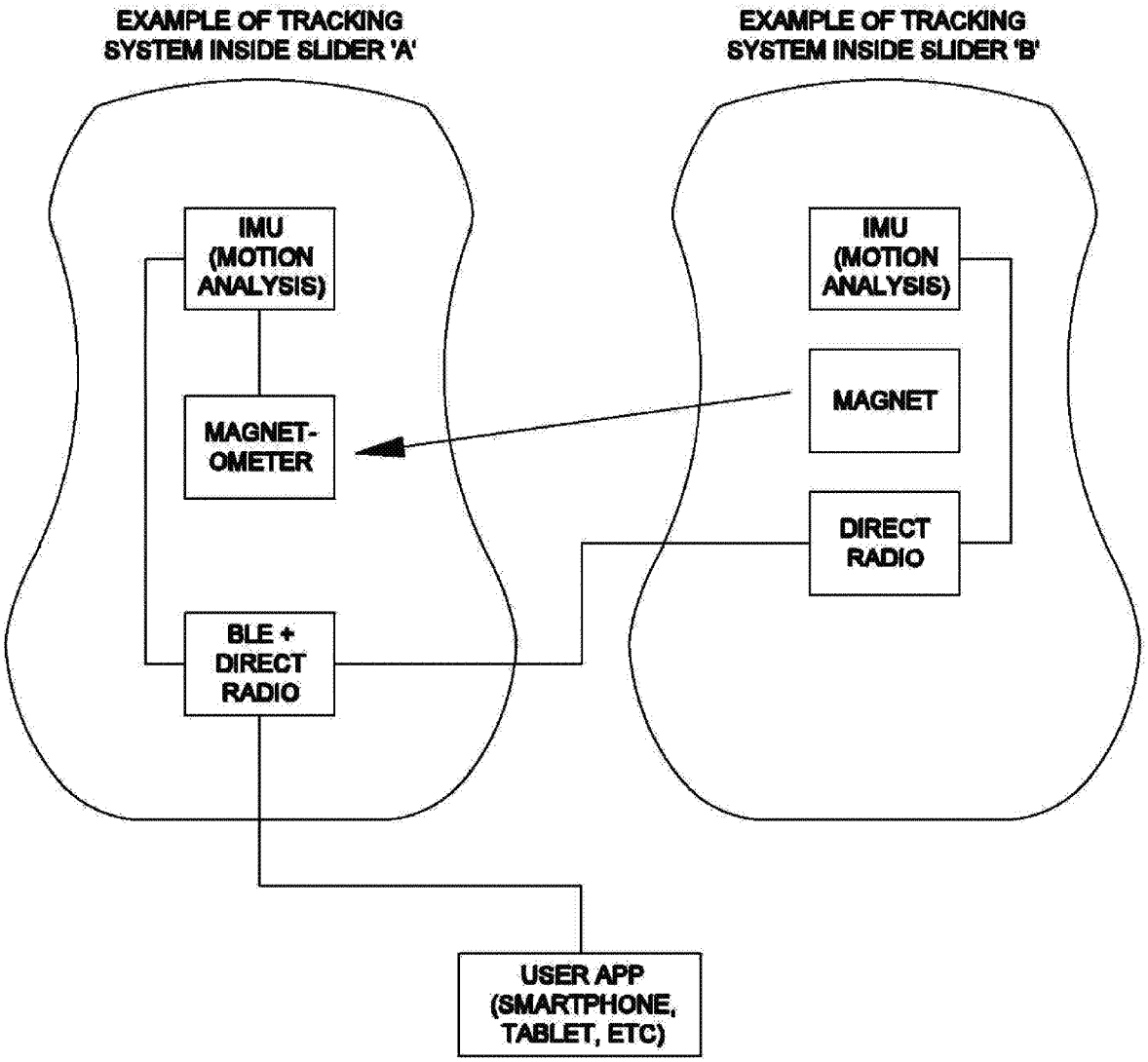
Figure 5F:
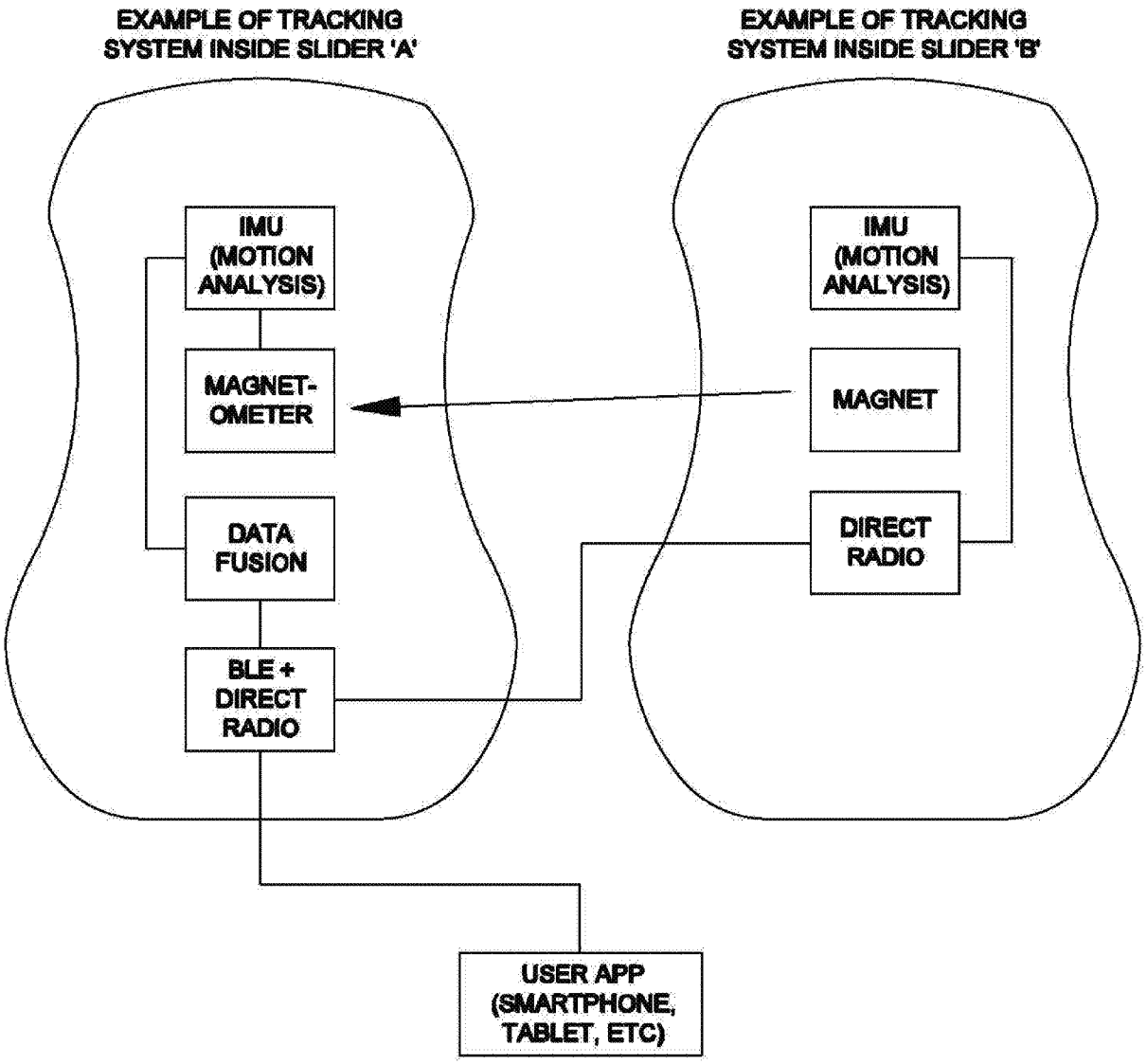

In FIG. 5E, slider "A" includes an IMU for motion sensing and both direct radio and BLE capability, or other communication device. The IMU will include a (minimum) 3-axis accelerometer, a (minimum) 3-axis gyroscope, and a magnetometer. Slider "B" includes an IMU for motion sensing, a magnet fixed in place inside the device and uses direct radio to transmit its data to the slider "A". The IMU in $2^{nd}$ device (slider B) will include a (minimum) 3-axis accelerometer and a (minimum) 3-axis gyroscope. Data is transferred at set intervals via BLE to external processing. Activity is calculated by analysis of IMU data of slider "A" combined with slider "B". In FIG. 5F, an on-board data fusion is added to slider "A", wherein the on-hoard data fusion enables all relevant processing to be performed and completed on the slider "A" such that the system doesn't depend on an external application for data processing as the configuration in FIG. 5E.

In all cases the algorithm for calculating spent energy produces output in relative "activity units" which are then translated into statistics such as equivalent steps taken and number of calories burned while using the exercise system. Those using the exercise system will view the statistics on a client side application loaded onto a device such as a smartphone or tablet. Having activity tracking components in both sliders allows for accurately providing statistics to the user.

Although the invention has been described in considerable detail in language specific to structural features and or method acts, it is to be understood that the invention defined in the appended claims is not necessarily limited to the specific features or acts described. Rather, the specific features and acts are disclosed as exemplary preferred forms of implementing the claimed invention. Stated otherwise, it is to be understood that the phraseology and terminology employed herein, as well as the abstract, are for the purpose of description and should not be regarded as limiting. Therefore, while exemplary illustrative embodiments of the invention have been described, numerous variations and alternative embodiments will occur to those in the art. Such variations and alternate embodiments are contemplated, and can be made without departing from the spirit and scope of the invention. For instance, the body portion may be constructed from a substantially circular shape, providing an advantageous weight distribution of components allowing the device to be easily moved in any direction during use regardless of orientation.

It should further be noted that throughout the entire disclosure, the labels such as left, right, front, back, top, bottom, forward, reverse, clockwise, counter clockwise, up, down, or other similar terms such as upper, lower, aft, fore, vertical, horizontal, oblique, proximal, distal, parallel, perpendicular, transverse, longitudinal, etc. have been used for convenience purposes only and are not intended to imply any particular fixed direction or orientation. Instead, they are used to reflect relative locations and/or directions/orientations between various portions of an object.

In addition, reference to "first," "second," "third," and etc. members throughout the disclosure (and in particular, claims) are not used to show a serial or numerical limitation but instead are used to distinguish or identify the various members of the group.

What is claimed is:

1. A seated exercise system comprising:

a pair of sliders devices, each slider device comprising:

a body portion having a continuous side wall and a support surface, wherein the support surface is sized and shaped to receive a foot of a user;

a floor portion configured to slide on a floor surface during operation;

a grip portion attached to the support surface, wherein the grip portion is constructed from a traction material providing traction to the foot during operation; and, motion tracking components configured to detect movement data of the foot and during operation;

wherein at least one slider of the pair of floor sliders is configured to communicate the detected movement data to the other slider; and, wherein at least one slider of the pair of floor sliders includes a wireless communication device configured to send the detected movement data a computerized device such that the detected movement data is available to the user.

2. The seated exercise system of claim 1, wherein the floor portion is constructed from a low friction polymer configured for operation on a carpeted surface.

3. The seated exercise system of claim 2, wherein the low friction polymer is Polytetrafluoroethylene (PTFE).

4. The seated exercise system of claim 1, wherein the floor portion is constructed from a low friction polymer configured for operation on a carpeted surface.

5. The seated exercise system of claim 1, wherein the traction material is rubber.

6. The seated exercise system of claim 1, wherein the traction material is selected from the group consisting of thermoplastic elastomers (TPE), styrene ethylene butylene styrene (SEBS), or thermoplastic polyurethane (TPU).

7. The seated exercise system of claim 1, wherein the body portion includes a retaining lip located on the perimeter of the support surface to retain the grip portion.

8. The seated exercise system of claim 1, wherein the grip portion includes a rectangular cutout in a center section of the grip portion, wherein the rectangular cutout allows an identifying mark included on the support surface of the body portion to be visible.

9. The seated exercise system of claim 1, wherein the body portion includes a plurality of cavities and structural support.

10. The seated exercise system of claim 9, wherein the plurality of cavities provide containment for the motion tracking components and at least one optional weight.

11. The seated exercise system of claim 10, wherein the least one weight provides resistance during operation.

12. The seated exercise system of claim 1, wherein the motion tracking components include an inertial measurement unit having at least a 3-axis accelerometer and a 3-axis gyroscope.

13. The seated exercise system of claim 1, wherein the detected movement data is processed by the computerized device.

14. The seated exercise system of claim 1, wherein the detected movement data is processed by a data fusion processor provided on at least one slider device of the pair of slider devices.

* * * * *